United States Patent [19]

Reist et al.

[11] 4,039,182

[45] Aug. 2, 1977

[54] APPARATUS FOR TRANSFERRING PIECE GOODS, ESPECIALLY PRINTED PRODUCTS, ARRIVING IN SUCCESSION FROM A FIRST INDIVIDUAL CONVEYOR TO A SECOND INDIVIDUAL CONVEYOR

[75] Inventors: Walter Reist, Hinwil; Hans-Ulrich Stauber, Grut, both of Switzerland

[73] Assignee: Ferag AG, Hinwil, Switzerland

[21] Appl. No.: 757,086

[22] Filed: Jan. 5, 1977

[30] Foreign Application Priority Data

Jan. 16, 1976 Switzerland ..... 475/76

[51] Int. Cl.[2] ..... B65H 29/04

[52] U.S. Cl. ..... 271/64; 271/204

[58] Field of Search ..... 271/277, 64, 204, 205, 271/206, 82; 198/479, 653, 696

[56] References Cited

U.S. PATENT DOCUMENTS

| | | | |
|---|---|---|---|
| 3,032,341 | 5/1962 | Reist | 271/206 X |
| 3,122,362 | 2/1964 | Vollrath | 271/204 X |
| 3,955,667 | 5/1976 | Muller | 198/696 |

*Primary Examiner*—Richard A. Schacher

*Attorney, Agent, or Firm*—Werner W. Kleeman

[57] ABSTRACT

An apparatus for transferring successively arriving piece goods, especially printed products, from a first individual conveyor to a second individual conveyor, each of the individual conveyors being provided with tandemly arranged, controlled grippers each of which serve to grip one of the piece goods. Between both of the individual conveyors there is arranged a third revolving individual conveyor equipped with controlled entrainment members. Each of the entrainment members serving to seize or engage one of the piece goods. The conveying-active run of the third individual conveyor can be introduced at its end regions into the conveying paths of the first and second individual conveyors. A drive which is controlled by the first and/or the second individual conveyor is provided for the third individual conveyor. The entrainment members, at the overlapping zones of the end regions of the conveying-active run of the third individual conveyor, are controlled to work in opposed relation to the grippers of the first individual conveyor and the grippers of the second individual conveyor.

25 Claims, 9 Drawing Figures

APPARATUS FOR TRANSFERRING PIECE GOODS, ESPECIALLY PRINTED PRODUCTS, ARRIVING IN SUCCESSION FROM A FIRST INDIVIDUAL CONVEYOR TO A SECOND INDIVIDUAL CONVEYOR

BACKGROUND OF THE INVENTION

The present invention relates to a new and improved construction of apparatus for transferring successively incoming piece goods, especially printed products, from a first individual conveyor to a second individual conveyor, both of the individual conveyors being equipped with tandemly arranged, controlled grippers, each gripper serving to grip a respective one of the piece goods.

SUMMARY OF THE INVENTION

It is a general object of the present invention to provide an improved construction of apparatus for reliably, positively, quickly and protectively transferring piece goods, especially printed products, arriving in succession from a first individual conveyor to a second individual conveyor.

Still a further important object of the present invention aims at the provision of novel transfer apparatus for articles, expecially printed products, between two individual conveyors, which transfer apparatus is relatively simple in construction and design, relatively economical to manufacture, extremely reliable in operation, and requires a minimum of maintenance and servicing.

Now in order to implement these and still further objects of the invention, which will become more readily apparent as the description proceeds, the proposed apparatus of the invention is manifested by the features that a third revolving individual conveyor is arranged between both the first and second individual conveyors. This third individual conveyor is equipped with controlled entrainment members, each coacting with an individual one of the piece goods, and wherein the conveying active-run of the third individual conveyor can be introduced at its end regions into the conveying paths of the first and second individual conveyors. Further, a drive controlled by the first individual conveyor and/or the second individual conveyor is provided for the third individual conveyor. The entrainment members, at the overlapping zones of the end regions of the conveying-active run of the third individual conveyor, are controlled to function in an opposite operational sense to the grippers of the first individual conveyor and the grippers of the second individual conveyor.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
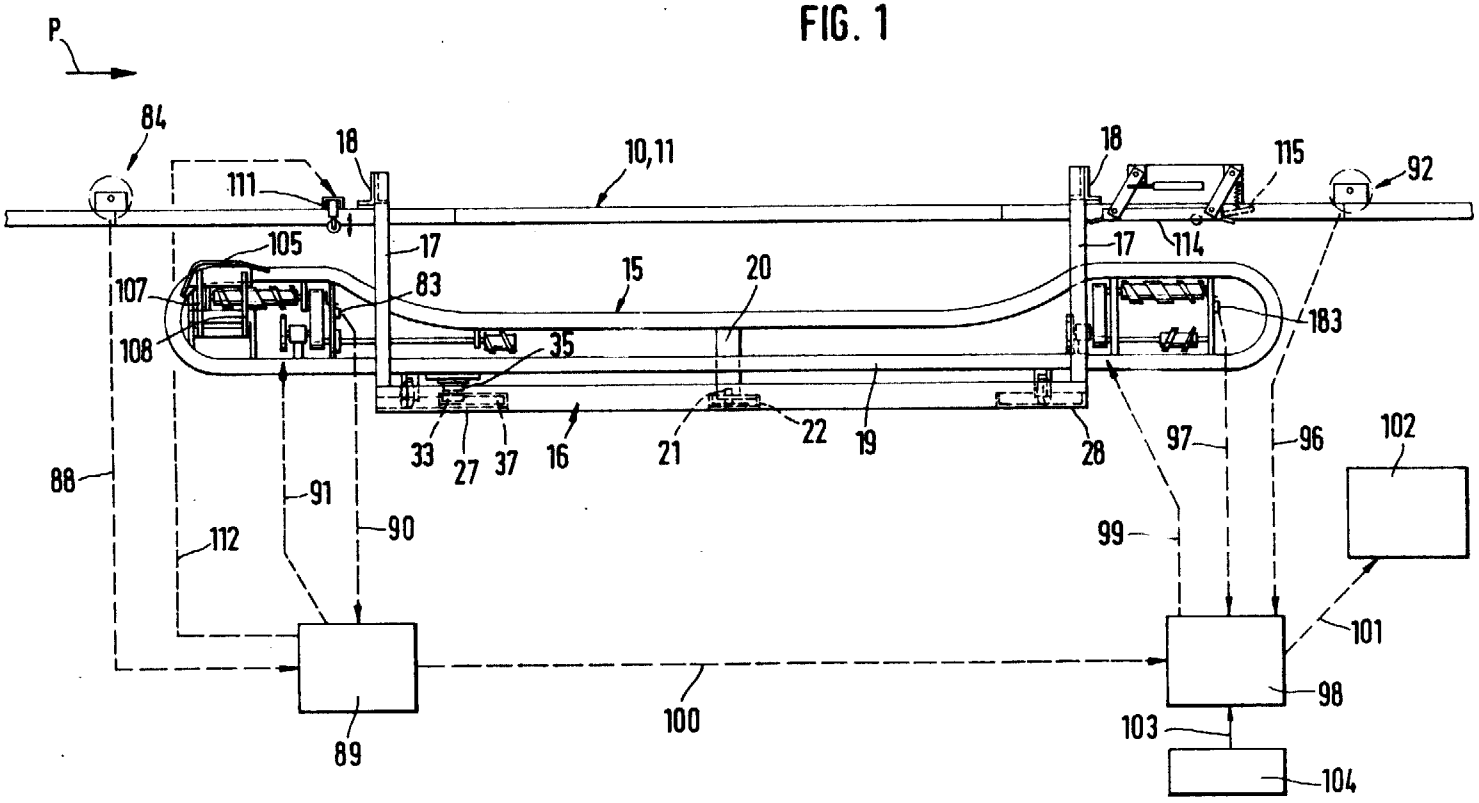
FIG. 1 is a schematic side view of apparatus constructed according to the present invention.
Figure 2:
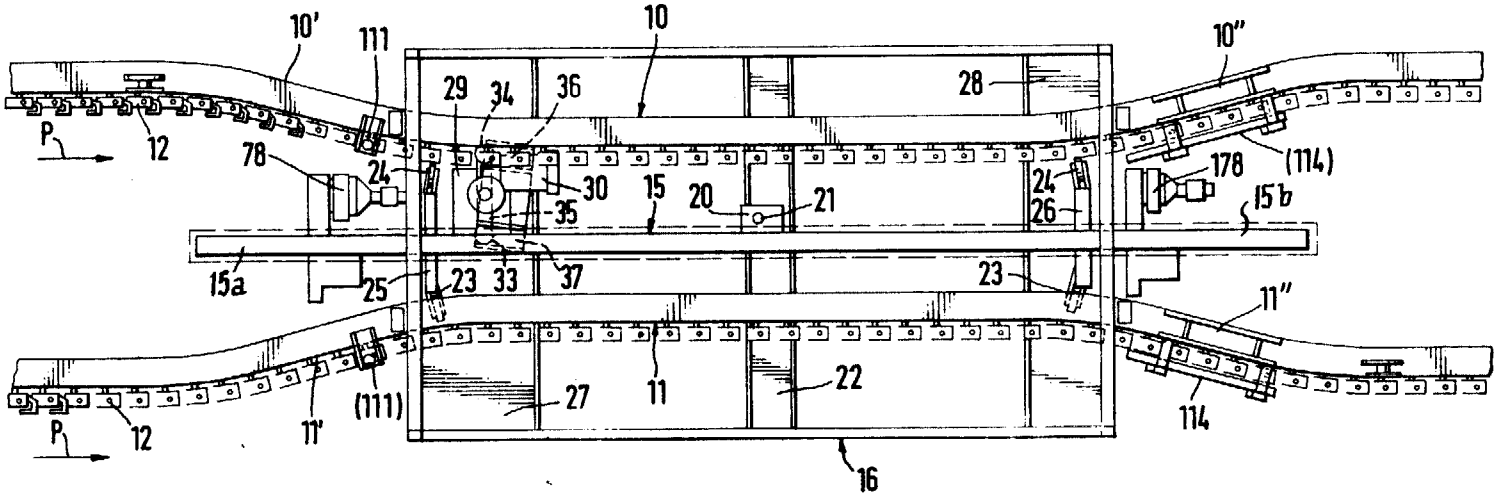
FIG. 2 is a top plan view of the apparatus of FIG. 1, wherein the third individual conveyor is shown in a position where it is out of operation, i.e. inaffectual.
Figure 3:
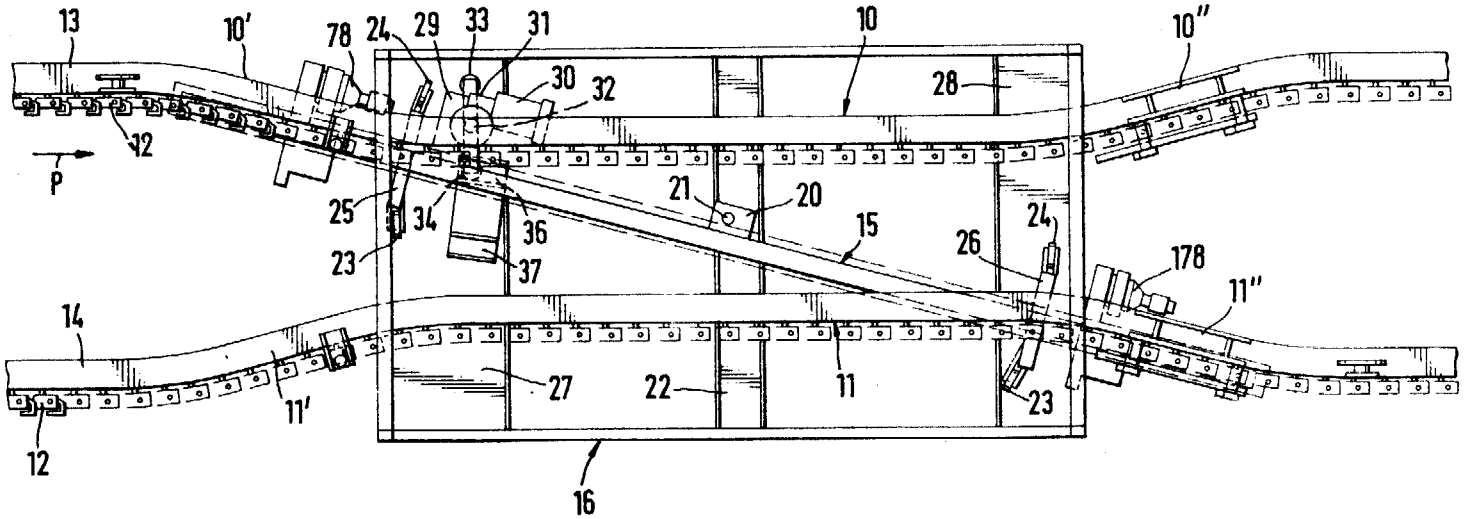
FIG. 3 is a top plan view of the apparatus of FIG. 1, wherein the third individual conveyor has been introduced at the starting and terminal regions of its conveying-active run into the respective conveying paths of the first and second individual conveyors.

Describing now the drawings, with the apparatus illustrated by way of example in FIGS. 1 to 3, there will be recognized a section of a first individual conveyor 10 as well as a section of a second individual conveyor 11. Both of these individual conveyors 10 and 11 are endless revolving conveyors, at each of which there are arranged, for instance by means of a chain, in constant spaced relationship behind one another i.e. in tandem, a respective multiplicity of individual controllable grippers 12. The revolving path of travel of the individual conveyors 10 and 11 is determined by the course or direction of a channel in an associated hollow rail 13 and 14 respectively. The individual conveyors 10 and 11 may be of the type disclosed, for instance, in German Patent publication No. 2,519,561 (corresponding to U.S. Pat. No. 3,955,667), to which reference may be readily had and the disclosure of which is incorporated herein by reference. Hence, it is unnecessary to here consider further details thereof, particularly since the construction and mode of operation of both individual conveyors 10 and 11 can be assumed to be known in the art. Considered in plan view, as shown in FIG. 2, a third individual conveyor 15 is arranged between both of the individual conveyors 10 and 11, and when considered in side view, as shown in FIG. 1, such third individual conveyor 15 is arranged below both of the individual conveyors 10 and 11. This individual conveyor 15 is supported upon a frame 16 to be pivotable in a substantially horizontal plane. Extending from the frame 16 are the columns 17, at which there are suspended by means of the angle profile members 18 the hollow rails 13 and 14 of the individual conveyors 10 and 11, and there is thus insured for a constant spacing of the frame 16 from the hollow rails 13 and 14.

The third individual conveyor 15 likewise possesses a hollow rail 19 which will be discussed more fully hereinafter, the course of which generally corresponds to the shape of an oval located in a vertical plane and slightly compressed together at its central region, as best seen by referring to FIG. 1. The hollow rail 19 is practically self-supporting and at the same time forms the frame of the third individual conveyor 15. At the center of the oval described by the hollow rail 19, there is secured to both oppositely situated sections thereof a sturdy column 20, the base of which is pivotably mounted upon a pivot pin or journal 21 which, in turn, is anchored at a transverse strut 22 of the frame 16. At the end or terminal regions of the oval the hollow rail 19 is additionally supported upon a respective travelling carriage 25 and 26 each equipped with two rolls 23, 24 which, in turn are each movable upon a wide transverse strut 27 and 28 respectively, of the frame 16. The axes or shafts of the rollers or rolls 24 and 25 are aligned in the direction of the pivot pin 21.

Figure 4:
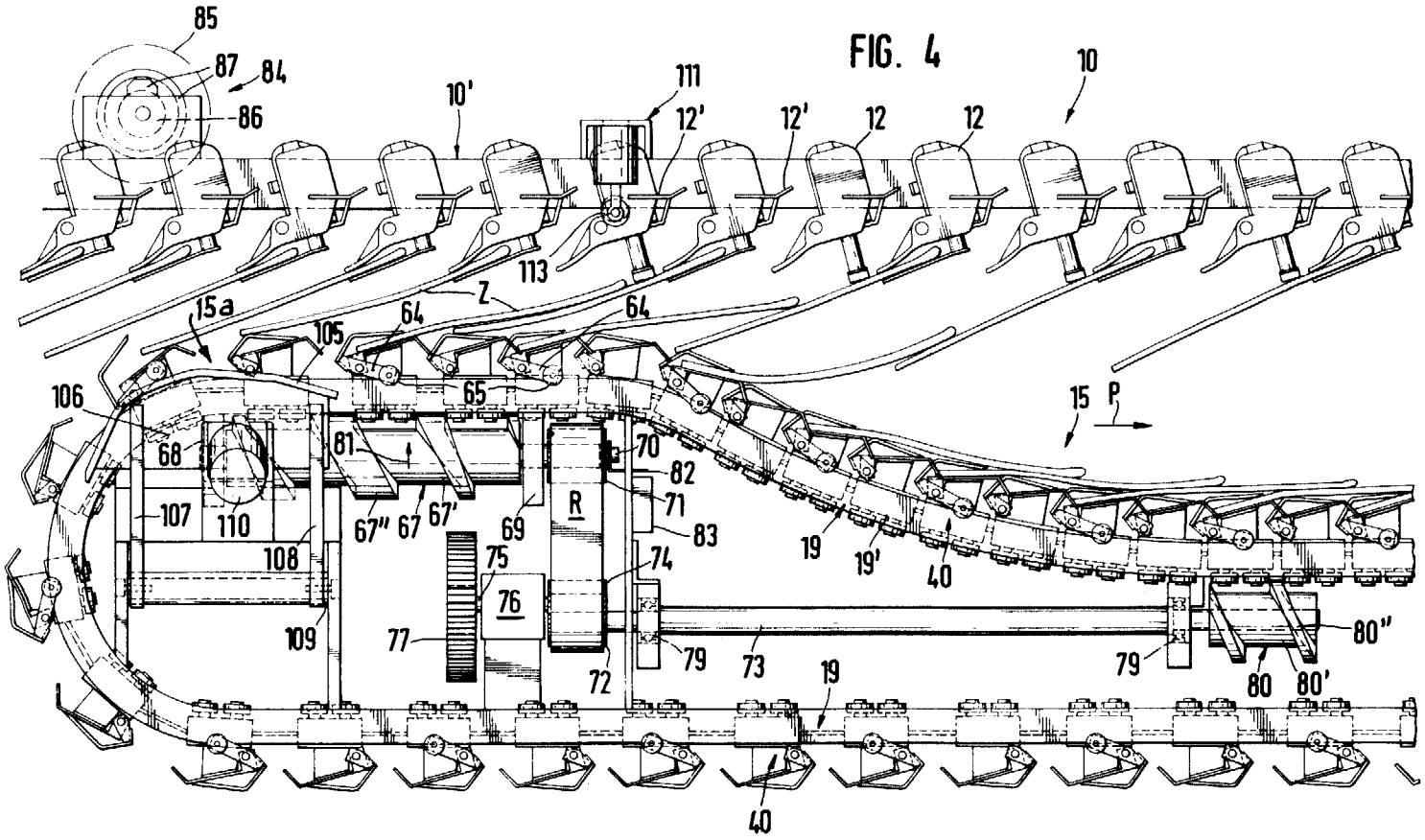
FIG. 4 is an enlarged side view of the starting region or portion of the conveying-active run of the third individual conveyor in its position where it has been introduced into the conveying path of the first individual conveyor.
Figure 5:
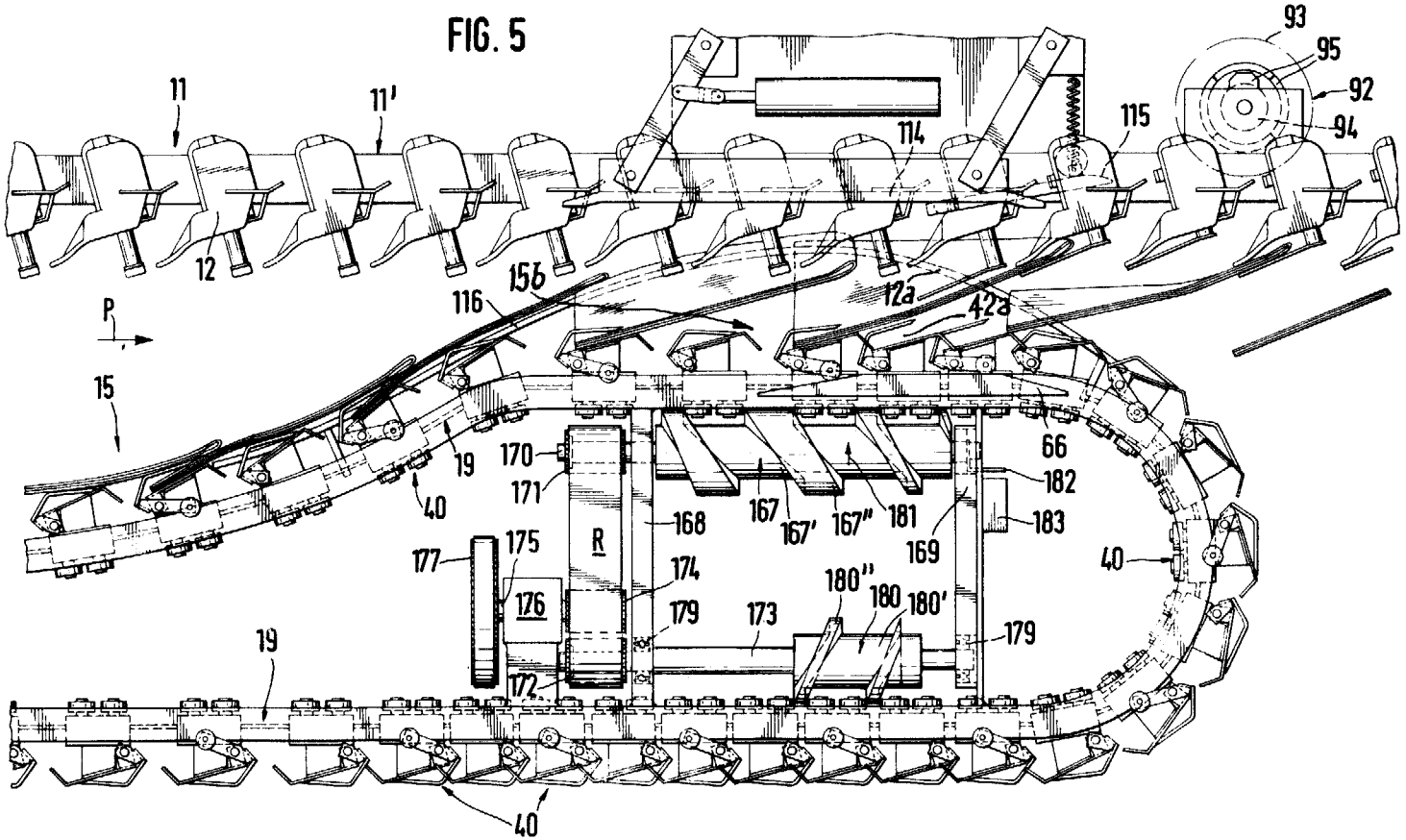
FIG. 5 is a view similar to the showing of FIG. 4 of the end of the conveying-active run of the third individual conveyor during transfer of the conveyed printed products to the second individual conveyor.
Figure 6:
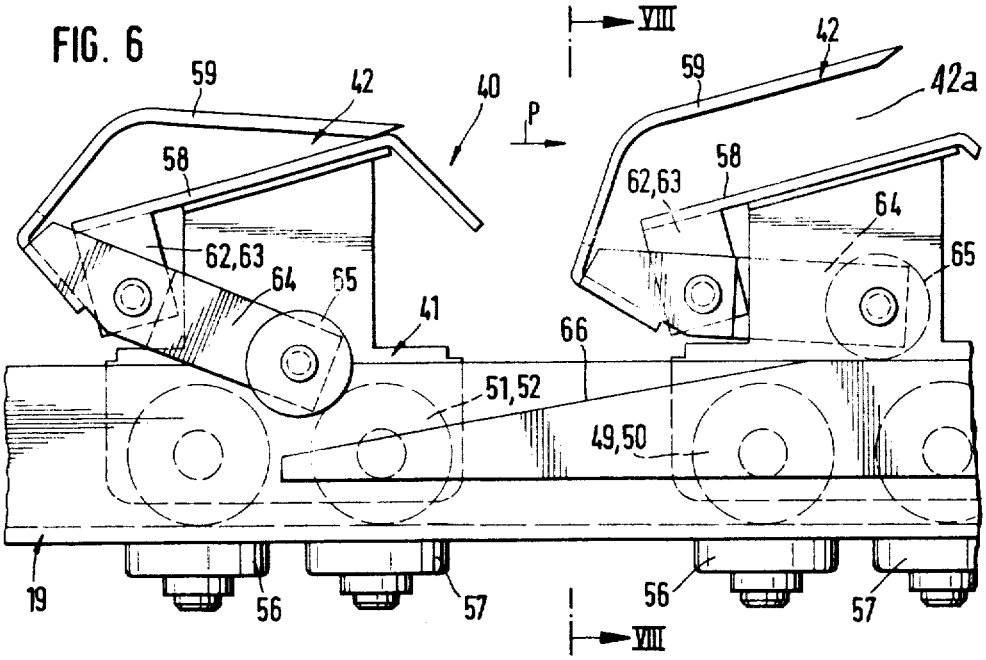
FIG. 6 is a side view, on an enlarged scale, showing a detail of the arrangement of FIG. 5.
Figure 7:
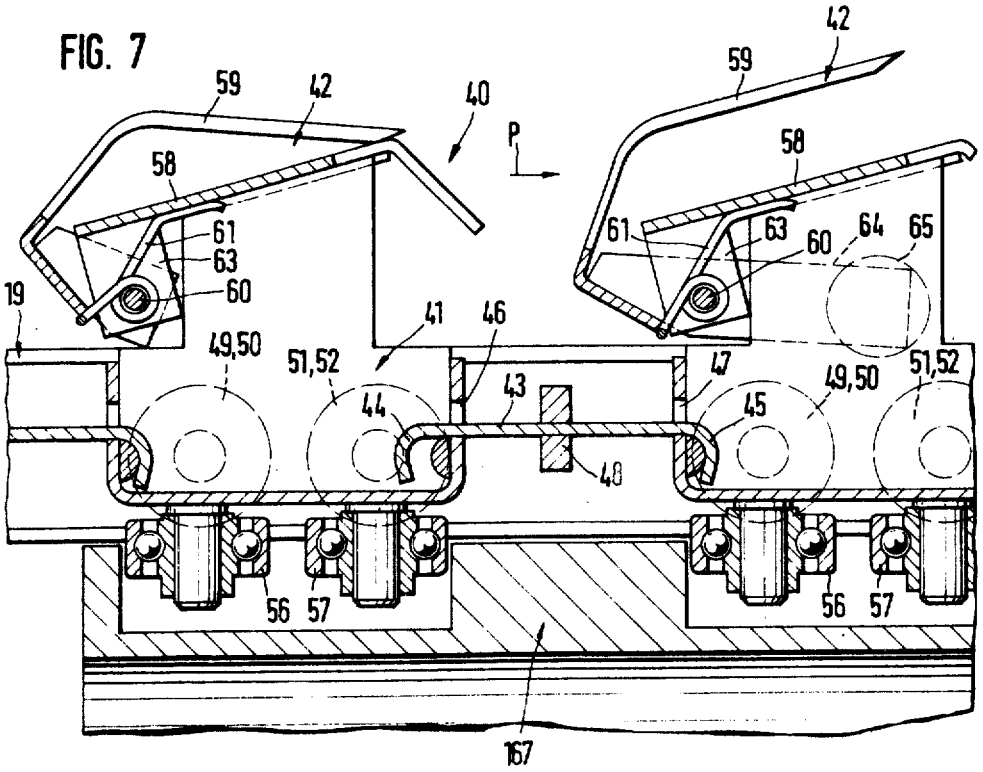
FIG. 7 is a cross-sectional view through the longitudinal central plane of FIG. 6, wherein the section line corresponds approximately to the line VI—VI of FIG. 8, and with part of the drive of the third individual conveyor being visible.
Figure 8:
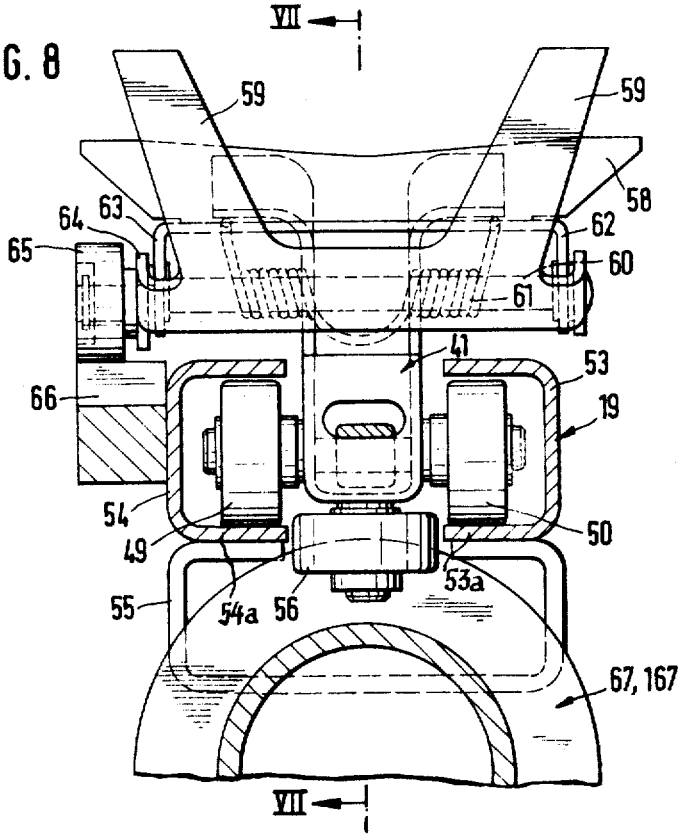
FIG. 8 is a cross-sectional view taken substantially along the line VIII—VIII of FIG. 6, where again part of the drive has been shown.
Figure 9:
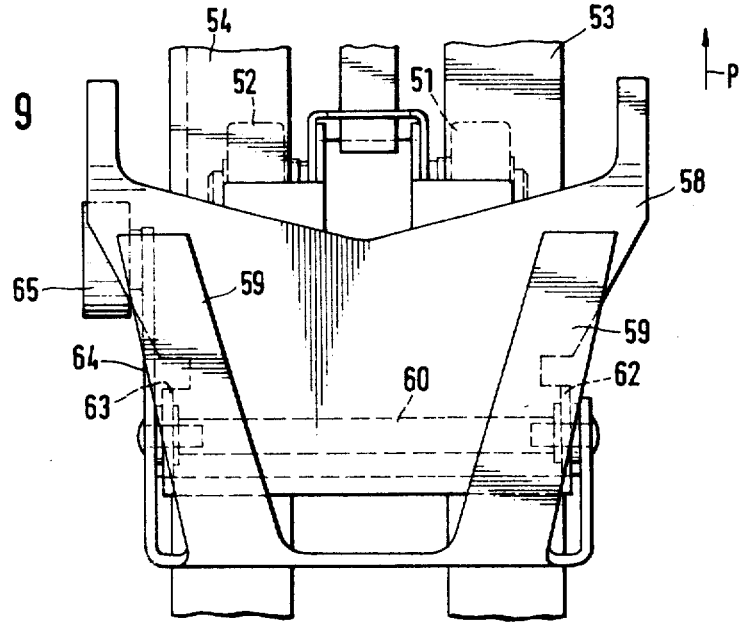
FIG. 9 is a top plan view of an entrainment member of the third individual conveyor.

As will still be described more fully in conjunction with FIGS. 4 and 5, the conveyor drives of the third individual conveyor 15 are directly secured to its hollow rail 19 and together therewith pivotable about the pivot pin 21. In order to rock or pivot the third individual conveyor 15, there is provided a separate drive which has been schematically illustrated in FIGS. 2 and 3. At a plate 29 which protrudes laterally from the hollow rail 19 there is secured a stop or cutoff motor 30 having a substantially horizontal axis. This stop motor 30 drives, by means of miter gearing, for instance worm gearing 31, a vertical pivot shaft 32. The lower end of this vertical pivot shaft 32 which confronts the transverse strut 27 has attached thereto a pivot lever 35 (FIG. 2) which carries at its opposite ends the rollers or rolls 33, 34. Secured to the transverse strut 27 are two parallely extending, upwardly open substantially U-shaped profile members 36, 37 into which there can engage the rollers 33 and 34. The spacing of the central planes of the U-shaped profile members 36 and 37 corresponds to the axial spacing of the rollers 33 and 34.

In FIG. 2, the roller 34 engages with the U-shaped profile member 36 and the roller 33 with the U-shaped profile member 37. Now if the stop motor 30 is turned-on for rotation in that direction and for such length of time that the pivot lever 35 moves through an angle of about 180° in the clockwise direction of FIG. 2, then it will be appreciated that the roller 33 moves out of the U-shaped profile member 37, the roller 34 initially travels further into the U-shaped profile member 36 and the hollow rail (and together therewith the entire individual conveyor 15) is rocked in clockwise direction about the pivot pin 21 until it has reached the position shown in FIG. 3 where only the roller 34 is fixedly retained in the U-shaped profile member 36. In this position the starting region **15*a* of the third individual conveyor 15 extends substantially parallel to a transfer section 10' of the individual conveyor 10 and the terminal or end region 15*b* extends substantially parallel to a transfer section 11'' of the individual conveyor 11. On the other hand, if starting from the position indicated in FIG. 2, the stop motor 30 is turned-on and rotated in a direction and for such length of time until the pivot lever 35 has carried out a rotation through an angle of 180° in the counterclockwise direction, then the individual conveyor 15 is likwise rocked in the counterclockwise direction until its starting region 15*a* and its end or terminal region 15*b* extend substantially parallel to a transfer section 11' of the individual conveyor 11 and substantially parallel to a transfer section 10'' of the individual conveyor 10**, respectively.

Consequently, it will be apparent that the illustrated apparatus is useful both for transferring printed products from the individual conveyor 10 to the individual conveyor 11 as well as also from the individual conveyor 11 to the individual conveyor 10. In the out-of-operation or ineffectual position, illustrated in FIG. 2, of the individual conveyor 15, there does not take place any transfer from the first individual conveyor to the second individual conveyor or vice-versa. In all instances, the conveying direction of the first and second individual conveyors has been indicated by the arrow P in FIGS. 1 to 3. Both of the individual conveyors 10 and 11 thus travel in the same sense or direction and parallel to one another at their sections illustrated in FIGS. 1 to 3.

Details of the third individual conveyor 15 will be described more fully hereinafter in conjunction with FIGS. 4 to 9. This individual conveyor 15 will be seen to encompass an endless revolving train or sequence of entrainment members 40, each of which has a respective carriage 41 guided within the hollow rail 19 and at each carriage there is secured a gripper clamp 42. As will be particularly apparent from the showing of FIGS. 6 and 7, the carriages 41 are coupled with one another by means of a drag connection, in this case shown by way of example as a connection bracket 43 bent at both ends, the bent ends 44 and 45 of which each engage through a corresponding opening 46 and 47 provided at the leading and trailing end walls, respectively, of two interconnected carriages 41. At the center of each connection bracket 43 there is provided a buffer or shock absorber disk 48. The carriages 41 can approach one another to a distance corresponding to the thickness of the buffer or shock absorber disk 48 and can move away from one another a distance determined by the length of the connection bracket 43. The maximum spacing of the carriages 41 from one another is chosen such that is corresponds at least to the spacing of successive grippers 12 of the individual conveyors 10 and 11 respectively, which spacing, as is known, is usually practically constant.

Each of the carriages 41 is equipped with two pairs of coaxial, freely rotatable rolls 49, 50 and 51, 52 respectively, each of which engage in one or two halves 53 and 54, of the hollow rail 19. Each of these rail halves or rail sections 53 and 54 possess a substantially C-shaped cross-section and confront one another at their open ends. At a uniform spacing along the length of the hollow rail 19, both of these rail halves 53 and 54 are interconnected by means of the connection brackets 55, so that there is maintained a constant spacing between the rail halves or rail sections 53, 54. Each of the carriages 41 is additionally equipped with two rolls 56 and 57 at the side opposite the gripper clamp 42. These rolls 56 and 57 in turn (if necessary) provide lateral guiding of the carriage 41 by rolling upon the end edges of the one leg **53*a* and 54*a* of the C-shaped halves or rail sections 53 and 54 respectively, and, on the other hand, also form a point of attack or engagement for the drive of the carriage 41**. This will be considered in greater detail shortly.

Each of the gripper clamps 42 possesses a stationary or fixed jaw 58 secured at the carriage 41 and a movable and bifurcated or forked jaw 59 which is rockable about a shaft 60 and can be pre-biased by means of a spring 61 towards the fixed jaw 58, i.e. pre-biased into the closed position. The shaft 60 is retained in flaps or tongue members 62, 63 bent downwardly to both sides of and out of the jaws 58 formed of sheet metal by way of example, as best seen by referring to FIGS. 6 to 8. An arm or arm member 64 is formed at each of the movable jaws 59, this arm 64 extending in the conveying direction P and carries at its end a follower element in the form of a freely rotatable roll 65. In this regard it is to be remarked that with the illustrated apparatus, viewed in the conveying direction P, the arms 64 of immediately successive gripper clamps 42 are alternately arranged at the one and at the other side of the associated carriage 41. From what has been explained, it will be apparent that the gripper clamps 41 can be opened for instance with the aid of suitable cams or control tracks or equivalent structure upon which travel the rolls 65. Such cams or control tracks are provided in FIG. 6 at the side confronting the observer as well as at the side facing away from the observer and have been designated by reference character 66. These cams or control tracks are also visible in FIG. 5. Furthermore, from the foregoing discussion and the showing of FIG. 5, it will be apparent that the mouth 42*a* of each of the gripper clamps 42, viewed in the conveying direction P, is open towards the front in contrast to the mouth 12*a* of the grippers 12, which, viewed in the same direction, is open towards the rear.

Equally, from what has been explained, it should be realized that the train or sequence of entrainment members 40 in the endless revolving hollow rail 19 possesses characteristics similar to a link chain guided in a tube. If the train of entrainment members 40 is pushed, then their mutual spacing is reduced to a minimum, whereas, on the other hand, if such is extended, then their mutual spacing is increased to the maximum extent permitted by each of the connection brackets 43.

The individual conveyor 15 possesses two mechanically independent drive units, one of which is effective upon the starting region or section 15*a* of the conveying-active run of the conveyor 15 and has been illustrated in FIG. 4, whereas the other acts upon the end or terminal region 15*b* of this run and has been illustrated in FIG. 5. With the exception of only a few minor constructional details, both of the drive units are structured to be extremely similar, so that the description at this location essentially relates to FIG. 4, whereas, for the showing of FIG. 5, functionally corresponding components have been simply designated with the same reference character, however, prefixed by the digit 1 i.e. increased by the number 100.

As already mentioned, the roller pair 56, 57 provided at each of the carriages 41 forms a point of attack or engagement for its drive. Hence, at the starting region 15*a* of the conveying-active run of the individual conveyor 15 (FIG. 4), directly below both of the rail halves 53, 54 of the hollow rail 19, there is arranged a substantially horizontal-axis worm 67, which is rotatably mounted in two cantilever bearings 68 and 69 depending downwardly from the hollow rail 19. Seated upon the shaft 70 of the worm 67 is a toothed drive roll 71 which is coupled by means of a toothed belt R with a further drive roll 72 seated upon a shaft 73 as well as with a drive roll 74 seated upon a shaft 75 (in FIG. 4 only partially visible). The shaft 75 is rotatably mounted in a bearing block 76 and additionally carries a drive disk 77 which is coupled by means of a further toothed belt with a motor 78 (FIGS. 2 and 3), the rotational speed of which is infinitely variable. The shaft 73, which is mounted in the roller bearings 79, carries at its end opposite the drive roll 72 a further worm 80.

The worm 67 is constructed such that with constant width of the groove or neck portion 67', between the turns of the threads it possesses an average pitch which decreases from the left towards the right of FIG. 4. The width of the groove or neck portion 67' is chosen such that the roller pair 56, 57 can engage therein. The profile of the worm 67 can be compared with that of a flat thread, wherein, however the width of the flank 67'' decreases from a maximum to a minimum value, viewed from the left towards the right of FIG. 4. This maximum value corresponds approximately to the maximum spacing of the successive carriages 41 from one another by virtue of the loose connection bracket 43 and the minimum value corresponds approximately to the minimum possible spacing between two successive carriages 41. The rotational speed of the worm 67, in the direction of the arrow 81, is chosen such that at the region of the end of the worm 67 appearing at the left of FIG. 4, each of the carriages can be shifted with a speed corresponding approximately to the conveying speed of the individual conveyor 10 arranged thereabove.

The width of the neck or groove portion 80' of the worm 80 corresponds to that of the groove or neck portion 67', and the width of the flanks 80'' at this worm corresponds to the already mentioned minimum value. Consequently, it will be seen that the sequence or train of carriages 41 and together therewith the entrainment members 40 are located in a "stretched" formation before they reach the worm 67, that the entrainment members 40 during their travel past the worm 67 are retarded or decelerated and thus caused to "close-up" with regard to the immediately leading entrainment member 40, and finally, that after departing from the worm 67, the formation of the train of entrainment members 40 can be considered as "closed in rank" or "dammed up". The worm 80 therefore serves to maintain this dammed-up formation also at the downwardly dropping section 19' and, accordingly, to prevent that successive carriages 41 will again move apart to the degree permitted by the connection bracket 43. First at the section of the conveying-active run following the worm 80, i.e. at the section adjoining at the right of FIG. 4, it is possible for the formation of successive entrainment members 40 to again stretch. From what has been discussed above, it will be apparent that the momentary rotational position of the worm 67 equally governs the momentary position of each one of the entrainment members 40 in engagement with the worm 67 along the hollow rail 19. This constitutes an important parameter for regulation purposes. In order to detect this parameter, there is secured to the shaft 70 a tongue or tab 82 or equivalent structure which, during each revolution, moves in a contactless manner past a transmitter, for instance, a proximity switch 83 which, in turn, delivers a signal during each revolution of the worm 67. This signal, as will be explained more fully hereinafter, is employed to control the motor 78.

From what has been discussed above, it should be apparent that any further description of the basically similarly constructed drive at the other terminal or end region of the conveying-active run of the individual conveyor 15 illustrated in FIG. 5 is unnecessary. It is here only to be remembered that functionally corresponding components have been designated with the same reference characters as used in FIG. 4, but additionally augmented by the prefix digit 1, as previously explained.

By virtue of the fact that the entrainment members 40 are loosely coupled to one another within a limited degree, it will be recognized that the drive of FIG. 4 and that of FIG. 5 must possess the same average or mean speed over longer periods of time, yet over shorter time intervals there are possible different speeds, and especially that the phase of both drives in relation to one another and in relation to the associated individual conveyors 10 and 11, can be changed at any time. This is important for the reason that the individual conveyor 15 must be accommodated to the rhythm or work cycle dictated by both the individual conveyor 10 and also the individual conveyor 11.

While particularly referring to FIG. 1, there now will be briefly explained the control of the drives of FIGS. 4 and 5. Shortly before the transfer location to the third individual conveyor 15, there is coupled with the conveyor 10 a signal transmitter 84 which is driven by a sprocket wheel 85 continuously meshing with the chain (not shown) of the conveyor 10. The signal transmitter 84 embodies a tachogenerator 86 as well as a clock generator 87. The tachogenerator 86 produces a signal which is characteristic of the conveying speed of the conveyor 10, whereas the clock generator 87 delivers a signal when ever one of the grippers 12 passes. Both of these signals of the signal transmitter 84 are delivered by means of a signal line 88 to a phase synchronization circuit 89 which also has delivered thereto, by means of a further signal line 90, the signals delivered by the proximity switch 83. The output line of the phase synchronization circuit 89 controls (if necessary, by means of an amplifier) the drive motor 78 (FIGS. 2 and 3) in such a manner that its rotational speed and therefore the rotational speed of the worm 67 (i.e. the feed speed and position of the entrainment member 40 engaged by the worm 67) is adjusted or accommodated to the feed speed and the position of the arriving gripper 12 of the conveyor 10, also while taking into account the format or shape of the printed product Z which is to be engaged.

The control of the drive for the end or terminal region of the individual conveyor 15, illustrated in FIG. 5, is accomplished in similar manner. A signal transmitter 92 is coupled with the portion of the conveyor 11 adjoining this end or terminal region. The signal transmitter 92 is driven by a sprocket wheel 93 which is continuously in meshing engagement with the chain (not shown) of such conveyor 11. The signal transmitter 92 comprises a tachogenerator 94 and a clock generator 95 which deliver signals characteristic of the speed of the conveyor 11 and characteristic of the position of the grippers 12 of such conveyor 11, respectively. The signal line 96 serves to couple the signal transmitter 92 with a phase synchronization circuit 98 which, by means of a further signal line 97, also has delivered thereto the signals of the proximity switch 183. The output line 99 of the phase synchronization circuit 98 controls the drive motor 178 in the manner similar to that already described.

It will be understood, however, that the drives of FIGS. 4 and 5, although mechanically independent of one another, must be coupled with one another as a function of the speed- and work cycle differences permitted by the individual conveyor 15 with respect to duration and magnitude. For this purpose the phase synchronization circuit 98 has delivered thereto the output signal of the phase synchronization circuit 89 by means of a control line or conductor 100. Furthermore, leading from the phase synchronization circuit 98 is a further output line 101 which controls the drive unit 102 for the individual conveyor 11, which drive unit has been schematically shown as a block.

Finally, there is also connected forwardly of the phase synchronization circuit 98, by means of a control line 103, a reference value transmitter 104 at which — considered electrically — there can be set the boundaries of the permissible phase displacements between the rotational positions (in complete revolutions) of the drive motors 78 and 178, or, — mechanically considered — the permissible minimum number and maximum number of entrainment members 40 present at any moment of time between the worm 67 and the worm 167. The total number of such entrainment members 40 at the individual conveyor 15 is indeed constant, but, due to the already mentioned loose coupling of the entrainment members 40 with one another, their number at the conveying-active run of the individual conveyor 15 can be varied between the worm 67 and the worm 167. Complementary to this variable number, also the number of entrainment means at the run which is returning to the starting region changes.

With the illustrated apparatus, the possible conveying capacity or output of the individual conveyor 10 is equal to the possible conveying capacity or output of the individual conveyor 11, i.e. with the same conveyor speed the grippers 12 of both conveyors follow one another at the same spacing. Accordingly, the possible conveying capacity or output of the individual conveyor 15 corresponds to that of the individual conveyors 10 and 11, i.e. the spacing of the entrainment members 40 at the acceptance- and at the transfer region, i.e. in the stretched formation, corresponds to that of the grippers 12. It is thus possible to transfer the entire quantity of printed products Z arriving at the individual conveyor 10 to the individual 11. In this case, the apparatus functions as a switch, and the individual conveyor 15 acts as a switch tongue.

Since, however, the transport capacity of both the individual conveyor 10 and also that of the individual conveyor 11, is accommodated to the production capacity of a modern day printing press, which capacity in many instances considerably exceeds that of the subsequently arranged processing stations, the illustrated apparatus also can beneficially serve the purpose of transferring, from the entire incoming quantity of printed products, only a part thereof, for instance, each second product copy, by means of the individual conveyor 15 to the individual conveyor 11. This exemplary embodiment of apparatus has been shown in FIGS. 4 and 5.

It has already been mentioned that the arms 64 of the gripper clamps 42 of successive entrainment members 40 are alternately arranged first at the one and then at the other side of the hollow rail 19. At the starting region **15*a* of the conveying-active run of the individual conveyor 15 (FIG. 4) there is thus provided to both sides of the hollow rail 19 a respective cam or control track 105 or equivalent structure which is intended to coact with the arm 64 located at such side. In FIG. 4 there is only visible the cam or control track 105 closer to the observer. The visible cam or control track 105 is (like the one at the side facing away from the observer) mounted upon a plate 106, from which emanate two pivotable arms 107 and 108. These pivotable arms 107 and 108 in turn are connected with one another at their free ends and are pivotable about a shaft 109 extending substantially parallel to the plane of the drawing of FIG. 4. The cam or control track 105 thus can be moved into and out of the path of movement of the arms 64 and the rolls 65 at the relevant side of the hollow rail 19. For this purpose there is provided an electromagnet 110 which, in conventional manner, brings about the desired retraction and extension of the cam or control track 105. The electromagnet 110 at the one as well as the other side of the hollow rail 19** can be energized by a not further illustrated yet conventional operating mode switch.

It is now assumed that the cam or control track 105 shown in FIG. 4 has been moved into the path of movement of the arms 64 and rolls 65 visible in FIG. 4, whereas the non-visible cam or control track at the other side of the hollow rail 19 has been retracted, i.e. brought into its ineffectual position. Consequently, upon passing the positionally effective cam 105 only each second one of the gripper clamps 42 is opened and comes into engagement with the trailing edge of the printed product Z held at its leading edge by one of the grippers 12. Consequently, it is only necessary to open each second one of the grippers 12 of the conveyor 10. This is accomplished by means of an electromagnet 111 provided at the conveyor 10. Electromagnet 111 receives its activating or switching-on pulse, for instance by means of a control line 112 (FIG. 1), from the phase synchronization circuit 89, which, in turn, derives such from the signals of the clock generator 87. At the armature of the electromagnet 111 there is attached a roll 113 which, when the electromagnet 111 is energized, is introduced into the path of movement of release lever 12' serving for the sudden opening of the gripper 12. Therefore, as will be clearly understood by referring to FIG. 4, only each second gripper 12 of the conveyor 10 is opened, whereas the remaining grippers move on further with their fixedly clamped printed product Z.

Now in FIG. 5 there is illustrated the reverse procedure which takes place at the end or terminal section **15*b* of the conveying-active run of the individual conveyor 15, which end section extends parallel to the take-up or transfer section 11'' of the individual conveyor 11 (cf. FIG. 3). Of course, in this case the cams or control tracks 66 at the conveyor 15 are arranged to both sides of the hollow rail 19, so that here each of the gripper clamps 42 is automatically opened. Additionally, there is provided at the take-up or transfer section 11'' of the conveyor 11, at one side thereof, a cam or control track 114 or equivalent structure which initially opens all of the incoming grippers 12 of the conveyor 11. Following the cam or control track 114, at the side facing away from the observer, is a further cam or control track 115, by means of which all of the grippers of the conveyor 11 during their through-passage are closed. The opening- and closing mechanism of the grippers 12** has been described in detail in the previously mentioned German Pat. publication No. 2,519,561 and its corresponding U.S. Pat. No. 3,955,667.

At the end of the conveying-active run of the individual conveyor 15 there are additionally provided the guide rails 116, upon which travel the leading edges of the printed products Z which have been forwardly displaced by the conveyor 15, and thus these leading edges are raised to the region of the take-up or transfer gripper 12 of the conveyor 11. This insures for a positive transfer of the printed products.

The illustrated apparatus exclusively engages the conveyed printed products centrally at their leading and at their trailing edges respectively. It is thus not dependent upon the size (format width) of the printed products extending transverse to the conveying direction. The illustrated apparatus likewise can be accommodated, without any considerable expenditure or problem, to another format length of the printed products. To this end it is sufficient, for instance, to adjust the rotational position of the tabs or tongues 82 and 182 with respect to the associated worms 67 and 167 respectively. Consequently, there is changed the spacing of the transferring or delivery grippers 12 at the conveyor 10 from the contemplated associated entrainment members 40 at the conveyor 15 and the spacing of the latter from the receiving or acceptance grippers 12 of the conveyor 11, without destroying the synchronization of the conveyor 15 at its start and at its end with respect to the conveyor 10 and the conveyor 11 respectively.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for transferring piece goods, especially printed products, arriving in succession from a first individual conveyor to a second individual conveyor, comprising, in combination:

a first individual conveyor movable along a first conveying path;

a second individual conveyor movable along a second conveying path;

a first group of tandemly arranged controlled grippers provided for the first individual conveyor, each of said grippers of the first group serving to engage one of the piece goods;

a second group of tandemly arranged controlled grippers provided for the second individual conveyor, each of said grippers of the second group serving to engage one of the piece goods;

a third revolving individual conveyor arranged between said first and second individual conveyors;

controlled entrainment members provided for the third revolving individual conveyor, each of said entrainment members serving to engage one of the piece goods;

said third individual conveyor having a conveying-active run including oppositely situated end regions;

means for introducing said conveying-active run of said third individual conveyor at its end regions into the respective conveying paths of the first and second individual conveyors to define overlapping zones between said end regions and said first and second individual conveyors;

drive means provided for the third individual conveyor;

means for controlling said drive means by means of at least one of said first and second individual conveyors;

means for controlling the entrainment members at the overlapping zones of the end regions of the conveying-active run of the third individual conveyor to operate in opposed relation to the grippers of the first individual conveyor and the grippers of the second individual conveyor.

2. The apparatus as defined in claim 1, further including:

drag connection means for coupling said entrainment members with one another at a variable spacing from one another;

said drive means for the third individual conveyor comprising a drive unit provided at one end region and controlled by the first individual conveyor and a drive unit provided at the other end region and controlled by the second individual conveyor.

3. The apparatus as defined in claim 1, wherein:

each of the grippers of the first individual conveyor and the second individual conveyor has a mouth opening;

each of the entrainment members comprising gripper clamp means having a mouth opening confronting the mouth opening of an associated gripper of the first and second individual conveyors.

4. The apparatus as defined in claim 1, wherein:

said introducing means is capable of moving the third individual conveyor between an effectual position and an ineffectual position;

said third individual conveyor, when in its effectual position, having the end regions of its conveying-active run extending at the overlapping zones substantially parallel to sections of the first and second individual conveyors.

5. The apparatus as defined in claim 1, wherein:

said introducing means includes means for mounting said third individual conveyor to revolve in a substantially vertical plane;

said third individual conveyor having its conveying-active run constituting the upper run of the third individual conveyor.

6. The apparatus as defined in claim 4, wherein:

said introducing means includes means for mounting said third individual conveyor to revolve in a substantially vertical plane;

said third individual conveyor having its conveying-active run constituting the upper run of the third individual conveyor;

the end regions of the conveying-active run of the third individual conveyor extending below said sections of the first nd second individual conveyors.

7. The apparatus as defined in claim 6, wherein:

the conveying-active run of the third individual conveyor has an intermediate section which extends between its end regions at a lesser height than the end regions.

8. The apparatus as defined in claim 2, wherein:

the drive units at the end regions of the conveying-active run of the third individual conveyor each comprise a worm acting directly upon the entrainment members;

each worm having an axis extending substantially parallel to the associated end region;

each of said worms being driven by a drive assembly, the rotational speed of which is dependent upon the conveying speed of the first individual conveyor and the second individual conveyor, respectively.

9. The apparatus as defined in claim 8, further including:

a phase synchronization circuit for controlling each drive assembly;

a first respective signal transmitter provided for each said first and second individual conveyors;

said phase synchronization circuit being connected with said first signal transmitters;

a second respective signal transmitter provided for each said first and second individual conveyors;

said phase synchronization circuit being connected with said second signal transmitters;

said second signal transmitters generating signals indicative of the momentary position of the entrainment members at the end regions at the third individual conveyors.

10. The apparatus as defined in claim 9, including:

means for operatively coupling each of the second signal transmitters with the worm driving the associated end region.

11. The apparatus as defined in claim 1, further including:

means provided at the overlapping zone at the first individual conveyor for opening each second gripper thereof;

said controlling means for entrainment members comprising means provided at the third individual conveyor for placing each second entrainment member into a receiving position.

12. The apparatus as defined in claim 1, wherein:

said third individual conveyor comprises hollow rail means in which there are guided the entrainment members of the third individual conveyor;

said hollow rail means extending in a substantially closed configuration.

13. The apparatus as defined in claim 2, wherein:

said third individual conveyor comprises hollow rail means within which there are guided the entrainment members of the third individual conveyor;

said hollow rail means extending in a closed course;

a carriage provided for each entrainment member;

each said carriage having rolls by means of which said carriage is guided and movable within said hollow rail means;

said drag connection means comprising connection bracket means for intercoupling successive carriages with one another;

said connection bracket means allowing for relative movement of successive carriages between a minimum spacing and a maximum spacing.

14. The apparatus as defined in claim 13, wherein:

each carriage is provided with a gripper clamp.

15. The apparatus as defined in claim 14, wherein:

each gripper clamp comprises a stationary ripper jaw secured to the carriage and a movable resilient jaw pre-biased into a closed position.

16. The apparatus as defined in claim 15, further including:

a follower element provided for and moving along with each movable jaw;

stationary control means cooperating with the follower elements for bringing the associated jaw into its open position.

17. The apparatus as defined in claim 16, further including:

means provided at the overlapping zone at the first individual conveyor for opening each second gripper;

said controlling means for the entrainment members comprising means provided at the third individual conveyor for bringing each second entrainment member into a receiving position;

the follower elements of successive jaws being alternately arranged to opposite sides of the hollow rail means;

said means for bringing each second entrainment member into a receiving position comprises control means arranged to each side of the hollow rail means at a starting region of the third individual conveyor.

18. The apparatus as defined in claim 12, wherein:

said hollow rail means comprises a self-supporting structure;

said introducing means including pivot pin means for pivotably mounting the hollow rail means between an operable position and an inoperable position.

19. The apparatus as defined in claim 18, wherein: said pivot pin means has a substantially vertically extending axis;

said hollow rail means being hingedly connected approximately at the center of its extent at the pivot pin means;

travelling carriage means;

end sections of the hollow rail means being supported on said travelling carriage means.

20. The apparatus as defined in claim 19, wherein:

said travelling carriage means is secured to said hollow rail means.

21. The apparatus as defined in claim 18, wherein:

said introducing means includes a drive for pivoting the hollow rail means.

22. The apparatus as defined in claim 21, wherein said drive comprises a stop motor secured to said hollow rail means;

a pivotal lever having a pair of free ends equipped with rollers;

said stop motor driving said pivotal lever;

a stationary guide element with which engage said rollers;

said stop motor pivoting from its inoperable position the pivotal lever, in a given rotational direction through a predetermined angular movement.

23. The apparatus as defined in claim 8, wherein:

said third individual conveyor comprises hollow rail means within which there are guided the entrainment members of the third individual conveyor;

said hollow rail means extending in a closed course;

a carriage provided for each entrainment member;

each said carriage having rolls by means of which said carriage is guided and movable within said hollow rail means;

said drag connection means comprising connection bracket means for intercoupling successive carriages with one another;

said connection bracket means allowing for relative movement of successive carriages between a minimum spacing and a maximum spacing;

at least part of the rolls of each carriage extending out of the hollow rail means and at the region of the worms engaging into neck portions thereof between thread flanks of said worms.

24. The apparatus as defined in claim 8, wherein:

the worms with constant width of neck portions thereof between thread flanks of said worms, possess a pitch which decreases when viewed in the conveying direction.

25. An apparatus for transferring piece goods, especially printed products, arriving in succession from a first individual conveyor to a second individual conveyor, comprising, in combination:

a first individual conveyor movable along a first conveying path;

a second individual conveyor movable along a second conveying path;

a first group of tandemly arranged controlled grippers provided for the first individual conveyor, each of said grippers of the first group serving to engage one of the piece goods;

means for controlling the opening and closing movements of said first group of grippers;

a second group of tandemly arranged controlled grippers provided for the second individual conveyor, each of said grippers of the second group serving to engage one of the piece goods;

means for controlling the opening and closing movements of said second group of grippers;

a third individual conveyor arranged between said first and second individual conveyors;

controlled entrainment members provided for the third individual conveyor, each of said entrainment members serving to engage one of the piece goods;

said third individual conveyor having a conveying-active run including oppositely situated end regions;

means for introducing said conveying-active run of said third individual conveyor at its end regions into the respective conveying paths of the first and second individual conveyors;

drive means provided for the third individual conveyor;

means for controlling said drive means by means of at least one of said first and second individual conveyors;

means for controlling the entrainment members at the end regions of the conveying-active run of the third individual conveyor to operate with an opening and closing movement which is opposite to the opening and closing movements of the grippers of the first individual conveyor and the grippers of the second individual conveyor.

* * * * *